US010006264B2

(12) United States Patent
Glaser et al.

(10) Patent No.: US 10,006,264 B2
(45) Date of Patent: Jun. 26, 2018

(54) WHIPSTOCK ASSEMBLY HAVING ANCHOR AND ECCENTRIC PACKER

(71) Applicant: Weatherford Technology Holdings, LLC, Houston, TX (US)

(72) Inventors: Mark C. Glaser, Houston, TX (US); Peter K. Chan, Kingwood, TX (US); Paul R. Northam, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 308 days.

(21) Appl. No.: 14/719,745

(22) Filed: May 22, 2015

(65) Prior Publication Data

US 2015/0345241 A1 Dec. 3, 2015

Related U.S. Application Data

(60) Provisional application No. 62/004,383, filed on May 29, 2014.

(51) Int. Cl.

| | |
|---|---|
| ***E21B 23/12*** | (2006.01) |
| ***E21B 33/128*** | (2006.01) |
| ***E21B 29/06*** | (2006.01) |
| ***E21B 33/129*** | (2006.01) |
| ***E21B 23/01*** | (2006.01) |

(52) U.S. Cl.

CPC ..... *E21B 23/002* (2013.01); *E21B 23/01* (2013.01); *E21B 29/06* (2013.01); *E21B 33/128* (2013.01); *E21B 33/1293* (2013.01)

(58) Field of Classification Search

CPC ..... E21B 23/002

USPC ..... 166/117.6

See application file for complete search history.

(56) References Cited

U.S. PATENT DOCUMENTS

| | | | |
|---|---|---|---|
| 4,153,109 | A | 5/1979 | Szescila |
| 4,285,399 | A | 8/1981 | Holland et al. |
| 4,304,299 | A | 12/1981 | Holland et al. |
| 4,307,780 | A | 12/1981 | Curington |
| 4,397,355 | A | 8/1983 | McLamore |
| 4,765,404 | A | 8/1988 | Bailey et al. |
| 4,807,704 | A | 2/1989 | Hsu et al. |

(Continued)

FOREIGN PATENT DOCUMENTS

| | | | |
|---|---|---|---|
| WO | 01/77480 | A1 | 4/2002 |

OTHER PUBLICATIONS

First Office Action in counterpart Canadian Appl. 2,892,567, dated Jul. 11, 2016, 4-pgs.

(Continued)

*Primary Examiner* — Giovanna C. Wright
*Assistant Examiner* — Jonathan Malikasim
(74) *Attorney, Agent, or Firm* — Blank Rome LLP

(57) ABSTRACT

A whipstock assembly has a whip, a packer, and an anchor. The packer connects between the whip and the anchor and sets after the anchor is set. The anchor can be set mechanically or hydraulically. To communicate hydraulic pressure to the hydraulically-set anchor, the packer can have an internal bypass for communicating fluid or for passing a hydraulic line from the whip to the anchor. The packer is set mechanically with set down weight applied from the whip via a setting tool or the like. The packer sets eccentrically in the casing and acts as a fulcrum to push the tip of the whip against the inside of the casing.

29 Claims, 13 Drawing Sheets

(56) References Cited

U.S. PATENT DOCUMENTS

| | | | | |
|---|---|---|---|---|
| 5,154,231 | A | 10/1992 | Bailey et al. | |
| 5,163,522 | A | 11/1992 | Eaton et al. | |
| 5,318,132 | A | 6/1994 | Odorisio | |
| 5,335,737 | A | 8/1994 | Baugh | |
| 5,341,873 | A | 8/1994 | Carter et al. | |
| 5,379,845 | A | 1/1995 | Blount et al. | |
| 5,425,417 | A | 6/1995 | Carter | |
| 5,425,419 | A | 6/1995 | Sieber | |
| 5,427,179 | A | 6/1995 | Bailey et al. | |
| 5,429,187 | A | 7/1995 | Beagrie et al. | |
| 5,452,759 | A | 9/1995 | Carter et al. | |
| 5,467,820 | A | 11/1995 | Sieber | |
| 5,467,821 | A | 11/1995 | Sieber | |
| 5,474,125 | A | 12/1995 | Sieber | |
| 5,474,131 | A | 12/1995 | Jordan, Jr. et al. | |
| 5,474,133 | A | 12/1995 | Sieber | |
| 5,499,682 | A | 3/1996 | Sieber | |
| 5,531,271 | A | 7/1996 | Carter | |
| 5,533,573 | A | 7/1996 | Jordan, Jr. et al. | |
| 5,584,350 | A | 12/1996 | Schnitker et al. | |
| 5,592,991 | A | 1/1997 | Lembcke et al. | |
| 5,636,692 | A | 6/1997 | Haugen | |
| 5,720,349 | A | 2/1998 | Pleasants et al. | |
| 5,740,864 | A | 4/1998 | de Hoedt et al. | |
| 5,806,596 | A | 9/1998 | Hardy et al. | |
| 5,979,570 | A * | 11/1999 | McLoughlin | E21B 47/18 175/24 |
| 6,050,334 | A | 4/2000 | McGarian | |
| 6,105,675 | A | 4/2000 | Buytaert et al. | |
| 6,145,593 | A | 11/2000 | Hennig | |
| 6,464,002 | B1 | 10/2002 | Hart et al. | |
| 6,761,217 | B1 * | 7/2004 | McGarian | E21B 7/061 166/117.5 |
| 6,843,314 | B2 * | 1/2005 | Toulouse | E21B 4/02 166/117.6 |
| 7,963,341 | B2 | 6/2011 | Rios, III et al. | |
| 2003/0034163 | A1 * | 2/2003 | Wilson | E21B 33/127 166/387 |

OTHER PUBLICATIONS

Weatherford, "Whipstocks and Whipstock Mills," Brochure, Copyright 2001.

Weatherford, "QuickCut Casing Exit System RHN-Type Anchor," Brochure, Copyright 2008.

Weatherford, "QuickCut Casing Exit System PHS-Type Anchor," Brochure, Copyright 2008-2010.

Weatherford, "QuickCut Casing Exit System RHS-Type Anchor," Brochure, Copyright 2006-2012.

Weatherford, "Openhole Whipstock Anchor Rok-ANkOR System," Brochure, Copyright 2012.

Weatherford, "Re-Entry Services," Brochure, Copyright 2012.

Search Report in counterpart UK Appl. GB1509088.9, dated Aug. 25, 2015.

Second Office Action in counterpart Canadian Appl. 2,892,567, dated Apr. 24, 2017, 4-pgs.

* cited by examiner

WHIPSTOCK ASSEMBLY HAVING ANCHOR AND ECCENTRIC PACKER

CROSS-REFERENCE TO RELATED APPLICATIONS

This is non-provisional of U.S. patent application Ser. No. 62/004,383, filed 29, May 2014, which is incorporated herein by reference in its entirety and to which priority is claimed.

BACKGROUND OF THE DISCLOSURE

For various reasons, operators may want to cut into the side of casing in an existing wellbore so a new sidetracked or lateral wellbore can be drilled. For example, the formation adjacent the original wellbore may become depleted or damaged, or a tool or pipe may have become stuck and may have blocked further use of the original wellbore. For whatever reason, the sidetracked wellbore can be drilled and then lined with pipe for additional operational uses.

As illustrated in FIG. 1A, a whipstock 20 according to the prior art can be used for diverting a milling tool to create a sidetracked wellbore 40. Operators run the whipstock 20 down the original wellbore's casing 12 to the desired location. The whipstock 20 has a wedge-shaped member or whip 22 with a concave face 24 that can steer a mill or cutter 42 to the side of the casing 12 where a window will be formed. Whipstocks and their use are known, and an example is shown in U.S. Pat. No. 6,464,002, which is incorporated by reference herein in its entirety.

The whipstock 20 may be run in by itself on a setting tool, and the mill 42 can be run in after the whipstock 20 has been set. Alternatively, to save a trip, the whipstock 20 can be run in with the mill 42 temporarily attached to its upper edge. In either case, the whipstock 20 uses an anchor 30 on its end so the whipstock 20 can be anchored in the wellbore 10 at the desired location. The anchor 30 sets in the casing 12 and keeps the whipstock 20 in place to resist the downward force placed upon it as the mill 42 moves along its length through the wall of the casing 12.

Various types of anchors can be used with the whipstock 20, and the anchors can be set mechanically or hydraulically. Mechanically-set anchors require a compressive force to shear a pin so the anchor can be set. These mechanical anchors work well when the anchor is to be set at the bottom of a wellbore or when there is some type of restriction that has been placed in the wellbore, like a bridge plug, against which the anchor can rest. In those instances, the stationary surface available in the wellbore allows operators to generate the compressive force needed to set the mechanical anchor.

In other instances, the anchor may be positioned at some point along the wellbore where there is no surface against which to create a compressive force. In these instances, the anchor can be set with pressurized fluid and requires a hydraulic mechanism.

One particular type of hydraulically-set anchor 30 for the whipstock 20 is shown in FIG. 1A. This anchor 30 and whipstock 20 can be similar to what is disclosed in U.S. Pat. No. 5,154,231. The hydraulically-set anchor 30 is attached to the end of the whipstock's whip 22. A running tool (i.e., string or the mill 42) detachably secures to the whip 22 for deployment and possible retrieval. In addition to these components, the whipstock 20 can have a locator sub with outwardly biased locator dogs (not shown) to engage in a prior milled positioning window (if formed) in the casing 12.

With the whipstock 20 positioned in the wellbore 10, the anchor 30 can be set to secure the whip 22 for the milling process. The running string (or mill 42 when used for run-in) can supply hydraulic fluid through a line to communicate with the anchor 30, pressurize the anchor's mechanism, and set the anchor 30 in the casing 12. For example, hydraulic fluid pressure is supplied to the anchor 30 and can expand slip elements 34 on the anchor 30 outwardly to engage the casing 12 and set the anchor 30. With the anchor 30 set, the mill 42 can then mill the wellbore diversion through the wall of the casing 12. After milling, the whipstock 20 may or may not be retrievable depending on its design.

Sometimes, the anchor 30 has a packer 32 that can isolate the lower portion of the wellbore 10 when set. Other times, isolation may not be necessary. Either way, being able to operate the packer 32 on the anchor 30 for the whipstock 20 offers some unique challenges.

One particular type of anchor 30 available in the art is shown in FIG. 1B and is disclosed in U.S. Pat. No. 7,963,341, which is incorporated herein by reference in its entirety. This anchor 30 has first and second inclined bodies 31*a-b* with a cavity 33*c* formed between their inclined surfaces 33*a-b*. The bodies 31*a-b* can slidably move relative to each other along a portion of their inclined surfaces 33*a-b* to increase an outer diameter of the anchor 30 in a set position. A biasing member 35 disposed in the cavity 33*c* can move the anchor 30 from a run-in position to the set position with the increased outer diameter. A triggering mechanism 37 initiates movement of at least one of the bodies 31*a-b* to the set position. The triggering mechanism 37 includes a shearable connection and a releasable locking connection that releases the biasing member 35.

Although existing whipstocks 20 and anchors 30 used in the art are effective. Operators are continually seeking new tools that can meet the new challenges experienced in the oil and gas industry around the world. For these reasons, the subject matter of the present disclosure is directed to overcoming, or at least reducing the effects of, one or more of the problems set forth above.

SUMMARY OF THE DISCLOSURE

A whipstock assembly positions in a wellbore having casing for forming a sidetrack. The assembly includes a whip, a packer, and an anchor. The packer extends from the whip and is mechanically activatable to seal in the casing, and the anchor extends from the packer and is activatable to anchor in the casing. The anchor sets in the casing before the packer is set. A first temporary connection between the packer and the whip releases in response to a mechanical setting force applied to the assembly, and the packer seals in the casing with the mechanical setting force. A second temporary connection between the packer and the whip releases in response to a mechanical releasing force applied to the assembly, and the whip disconnects from the packer with the mechanical releasing force.

In general, the packer has an end ring and a compressible packing element disposed thereon. The end ring is movable on the packer with the mechanical setting force and compresses the compressible packing element outward toward the casing. The packer can have at least one torque screw disposed thereon and engaged in at least one slot in the end ring, and the end ring can have a body lock connection with the packer.

In one embodiment, the anchor is a mechanically-set anchor that is mechanically activatable to anchor in the casing with a mechanical activation force. For the anchor to be set before the packer, the mechanical activation force for the anchor is at least less than the mechanical setting force of the packer.

In another embodiment, the anchor is a hydraulically-set anchor that is hydraulically activatable to anchor in the casing. Therefore, the assembly can include a hydraulic line communicating from the whip to the anchor via the packer. In one arrangement to accommodate the hydraulics, the packer defines an internal passage, and the hydraulic line for activating the anchor passes through the internal passage from the whip to the anchor. The internal passage can have a bulkhead connector disposed therein and through which a portion of the hydraulic line passes so that the internal passage is sealed.

In an alternative arrangement, a first portion of the hydraulic line can communicate from the whip with the internal passage on one side of the packer's compressible packing element, while a second portion of the hydraulic line can communicate with the internal passage on an opposite side of the packing element to the anchor. The packer's internal passage can thereby communicate the first and second portions of the hydraulic lines with one another. In this arrangement, the packer can have seals sealing at least the first portion of the hydraulic line from the internal passage when the first temporary connection is released in response to the mechanical setting force used to set the packer.

The first temporary connection can include an intermediate member connected to the whip and movably disposed adjacent the packer's compressible packing element. One or more first shear elements temporarily affix the intermediate member to the packer. For its part, the second temporary connection can include one or more second shear elements temporarily affixing the intermediate member to the packer's end ring movable against the compressible packing element.

As noted above, the anchor is set before the packer is set in the casing. The set anchor may thereby position the unset packer eccentrically in the casing. At least a portion of the eccentrically-positioned packer acts as a fulcrum point tending to position a tip of the whip against the casing.

A method of forming a sidetrack in a wellbore having casing involves deploying in the casing a whipstock assembly having a whip, a packer extending from the whip, and an anchor extending from the packer. The whipstock assembly anchors in the casing by setting the anchor in the casing, and the packer mechanically sets in the casing with a mechanical setting force after setting the anchor. At this point, various operations can be performed, namely forming the sidetrack in the wellbore with the assembly set in the casing.

Setting the anchor in the casing before setting the packer can involve positioning the unset packer eccentrically in the casing. In this way, at least a portion of the eccentrically-positioned packer can be used as a fulcrum point to urge a tip of the whip against the casing, which can have advantages disclosed herein.

Setting the anchor can involve mechanically setting the anchor with a mechanical activation force at least less than the mechanical setting force used for the packer. Alternatively, setting the anchor can involve communicating hydraulics from the whip to the anchor through the packer. To do this, a hydraulic line can communicate from the whip to the anchor through an internal passage of the packer.

In another arrangement, a first portion of a hydraulic line from the whip communicates to an internal passage of the packer on one side of a compressible packing element, while a second portion of the hydraulic line communicates from internal passage of the packer on an opposite side of the compressible packing element to the anchor. When the first temporary connection is released in response to the mechanical setting force, at least the first portion of the hydraulic line can seal from the internal passage.

Mechanically setting the packer in the casing involves moving an end ring on the packer with the mechanical setting force against a compressible packing element on the packer and compressing the compressible packing element outward toward the casing. This is done by freeing a first temporary connection of the assembly with the mechanical setting force applied to the assembly.

For the first temporary connection, an intermediate member connected to the whip is provided that is movably disposed adjacent the packer's compressible packing element. A temporarily affixing of this intermediate member to the packer can then be sheared so that the mechanical setting force can be applied to the packer's compressible packing element.

Eventually, the whip of the assembly can mechanically disconnect from the packer by freeing a second temporary connection between the packer and the whip with a mechanical releasing force applied to the assembly. Disconnecting the whip by freeing the second temporary connection between the packer and the whip with the mechanical releasing force can then involve shearing another temporarily affixing of the intermediate member to the packer's end ring, which is movable against the compressible packing element.

The foregoing summary is not intended to summarize each potential embodiment or every aspect of the present disclosure.

DETAILED DESCRIPTION OF THE DISCLOSURE

Figure 2A:
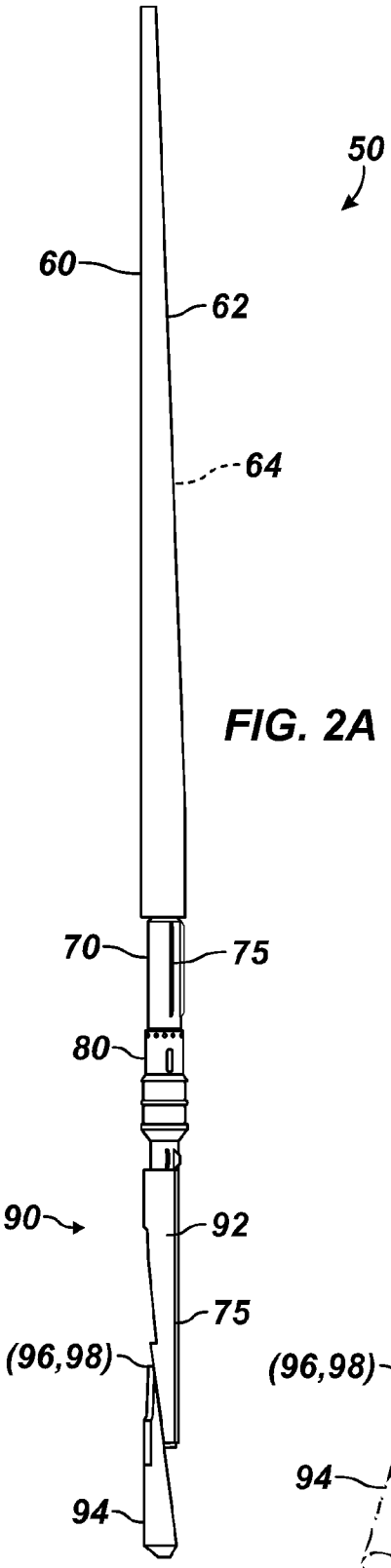
FIG. 2A illustrates an elevational view of a whipstock assembly according to the present disclosure.
Figure 2B:
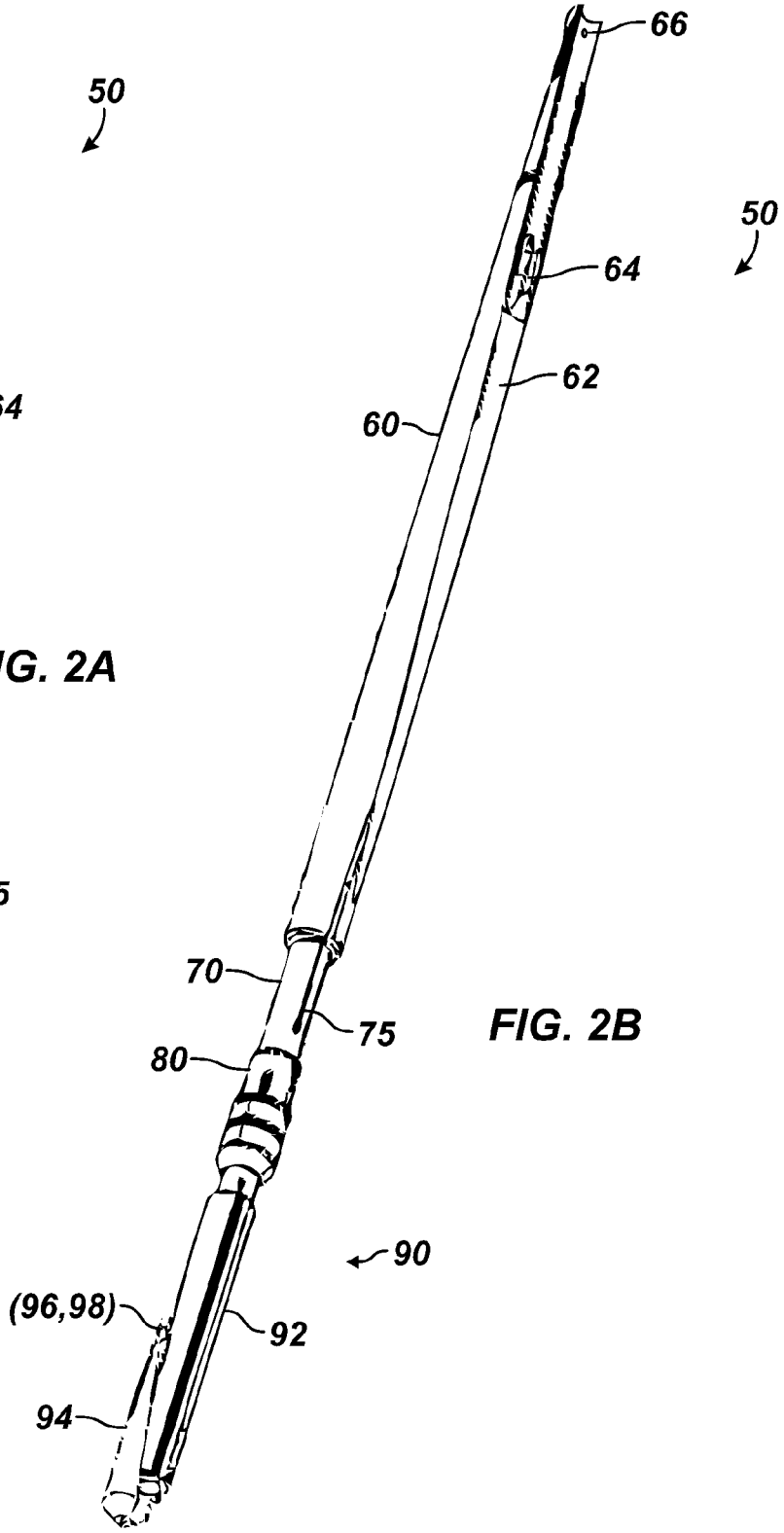
FIG. 2B illustrates a perspective view of the disclosed whipstock assembly.

FIGS. 2A-2B illustrate an elevational view and a perspective view of a whipstock assembly 50 according to the present disclosure. The whipstock assembly 50 includes a whip 60, an intermediate member 70, a packer 80, and an anchor 90.

The whip 60 is a wedge-shaped member with a concave face 62 that can steer a mill or a cutter (not shown) to the side of casing where a window can be formed. The intermediate member 70 connects the packer 80 to the lower end of the whip 60. The packer 80 is a permanent, compression-set packer that is run below the whip 60 and above the anchor 90 on the assembly 50. As will be discussed later, the packer 80 is set after the anchor 90 has been set.

Figure 3A:
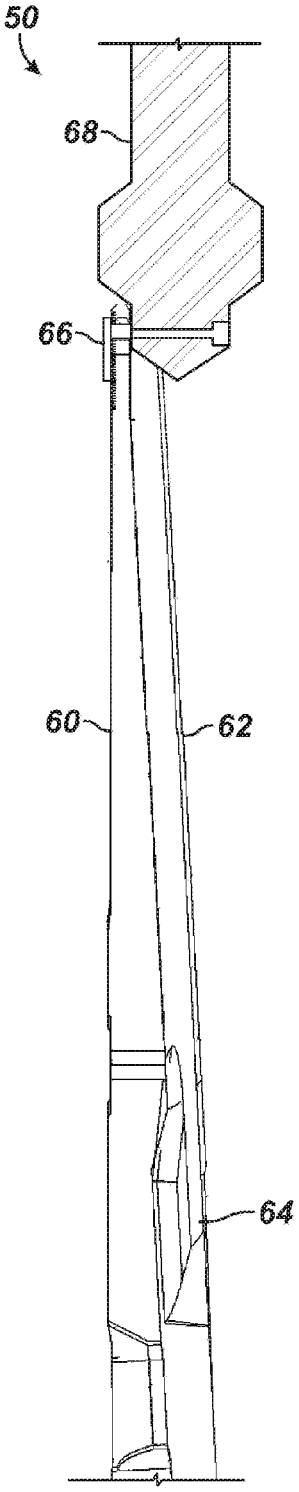
FIGS. 3A-3C illustrate detailed cross-sectional views of the disclosed whipstock assembly.

The anchor 90 can be set with hydraulic pressure using a hydraulic line 75, or the anchor 90 can be activated with set-down weight so no hydraulic line is required. For the hydraulically-set anchor 90, the hydraulic line 75 extends from a coupling (66: FIG. 2B) on the tip of the whip 60 where the setting tool or mill (e.g., 68: FIG. 3A) connects to the whip 60 for deploying the assembly 50. From there, the control line 75 passes along the intermediate member 70 to the packer 80 and then to the anchor 90.

In one arrangement, the packer 80 has an internal bypass for the transmission of hydraulic pressure to set the anchor 90. Alternatively, the hydraulic line 75 is run inside the packer 80 so the hydraulic line 75 can pass to the anchor 90. Further details of these features are discussed later.

For a mechanically-set anchor 90, use of the control line 75 is not necessary. In this case, the packer's internal dimension can be plugged with a small fitting to seal a fluid passage that would be present in the packer 80 for communicating with the hydraulically-set anchor 90. For example, the packer 80 can be filled with fluid and can have a mechanism that seals off the inside of the packer 80 as the packer 80 is set.

As noted above, the anchor 90 can be mechanically-set or hydraulically-set. Shown here, the anchor 90 is actuated hydraulically so the hydraulic line 75 runs from the whip 60, through the packer 80, and to the mechanisms of the anchor 90 so hydraulic fluid from a running tool or the like affixed at the whip 60 can communicate to the anchor 90 and set it in the casing 12.

Figure 1A:
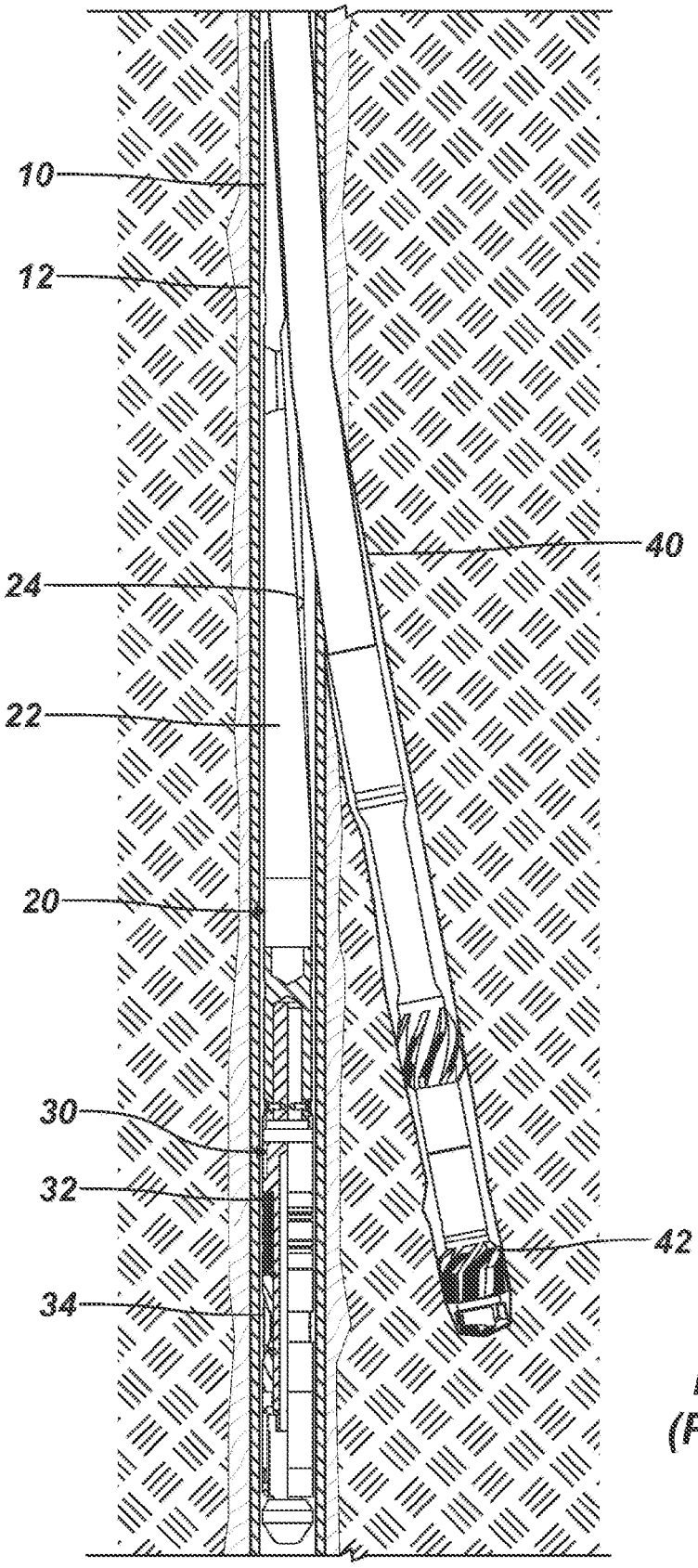
FIG. 1A (Prior Art)
FIG. 1A illustrates a whipstock assembly according to the prior art for diverting a milling tool to create a sidetrack wellbore.
Figure 1B:
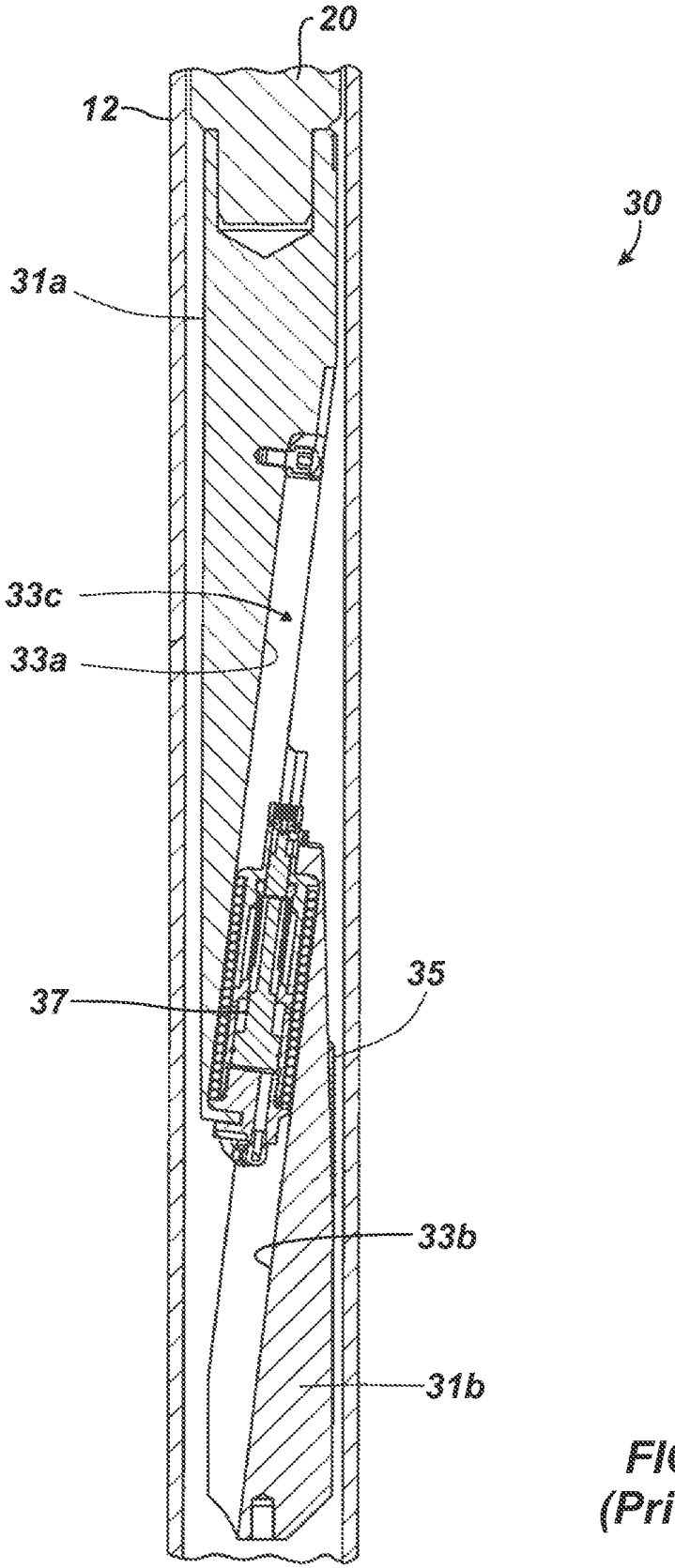
FIG. 1B (Prior Art)
FIG. 1B illustrates an anchor according to the prior art for a whipstock assembly.

As shown, the anchor 90 is similar to that shown in FIG. 1B and disclosed in U.S. Pat. No. 7,963,341, which is incorporated herein by reference in its entirety. The anchor 90 has first and second inclined bodies 92 and 94 with a cavity formed between their inclined surfaces. The bodies 92 and 94 can slidably move relative to each other along a portion of their inclined surfaces to increase an outer diameter of the anchor 90 to a set position. A biasing member (96) disposed in the cavity can move the anchor's bodies 92, 94 from a run-in position to the set position with the increased outer diameter. A triggering mechanism (98) initiates movement of at least one of the bodies 92 or 94 to the set position. The triggering mechanism (98) includes a shearable connection and a releasable locking connection that releases the biasing member (96).

Figure 3B:
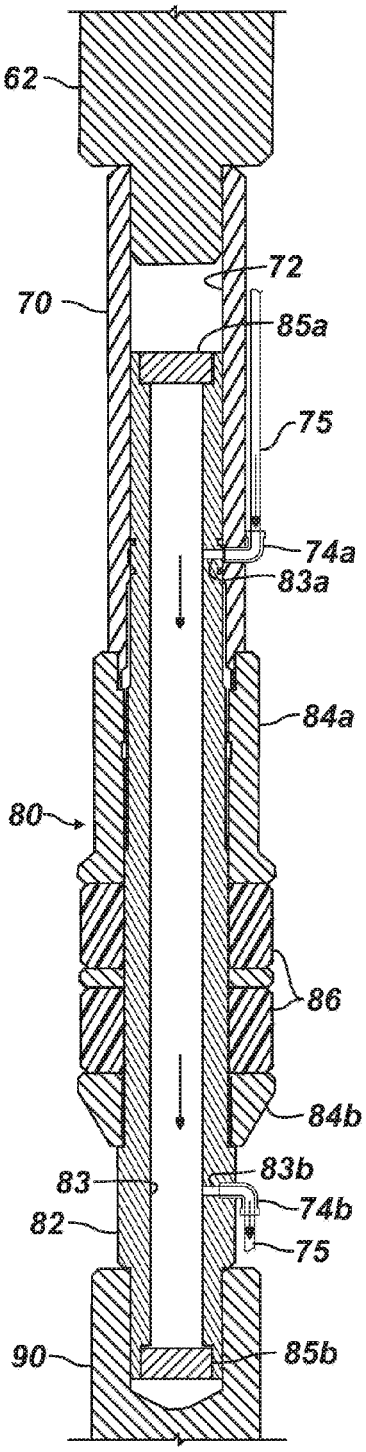
Figure 3C:
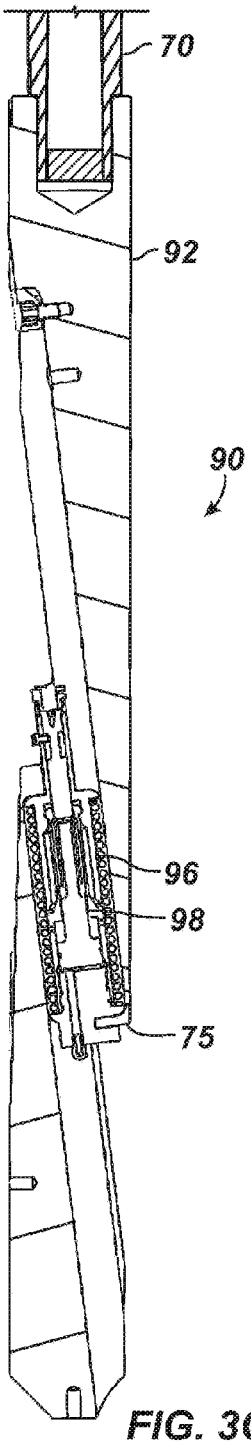

Discussion now turns to FIGS. 3A-3B, looking at the packer 80 and adjacent components of the assembly 50 in more detail. As shown in FIG. 3A, a detailed view of the whipstock assembly 50 illustrates a tip of the whip 60 with the mill 68 placed to attach at the coupling 66 on its distal end. FIG. 3B shows the proximal end of the whip 60 affixed to the packer 80 by the intermediate member 70. The packer 80 is also shown affixed to the upper end of the anchor 90. Finally, FIG. 3C shows details of the hydraulically-set anchor 90.

As best shown in FIG. 3B, the packer 80 includes a mandrel 82 having an upper (movable) end ring 84*a* and a lower (fixed) end ring 84*b* disposed thereon. One or more compressible packing elements 86 are disposed on the mandrel 82 between the end rings 84*a-b* and can be compressed between them during activation (discussed below). The mandrel 82 defines an internal bore 83 communicating along its length.

To communicate hydraulics from the whip 60 to the anchor 90, the hydraulic line 75 as shown in FIG. 3B extends from the whip 60 along the outside of the intermediate member 70. Terminating at a fitting 74*a*, hydraulic fluid from the line 75 can communicate through the intermediate member 70 and a mandrel port 83*a* into the bore 83 of the mandrel 82, which is disposed at least partially in a bore 72 of the intermediate member 70.

Communicated inside the mandrel's bore 83, the hydraulic fluid is held therein by end caps or seals 85*a-b* disposed at each end of the bore 83. The end caps 85*a-b* can be welded or otherwise affixed in place. This creates a fluid-filled chamber through packer 80. The hydraulic fluid from the bore 83 can pass through another mandrel port 83*b* to a fitting 74*b* on the lower end of the mandrel 82. From this fitting 74*b*, the hydraulic line 75 can run along the anchor 90 to then communicate with the anchor's trigger components 98.

Figure 4A:
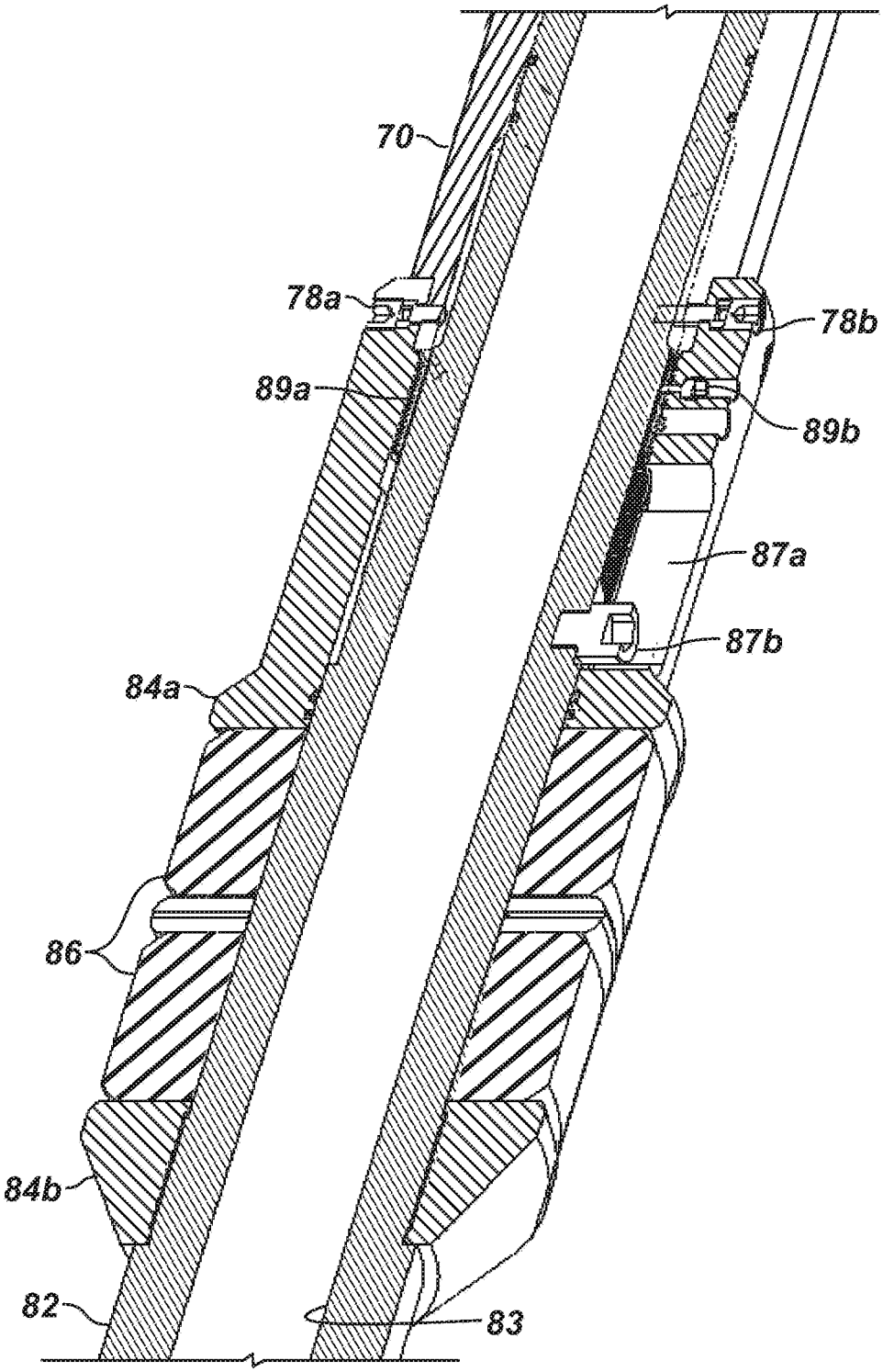
FIGS. 4A-4B illustrate cross-sectional views of the packer on the disclosed whipstock assembly.
Figure 4B:
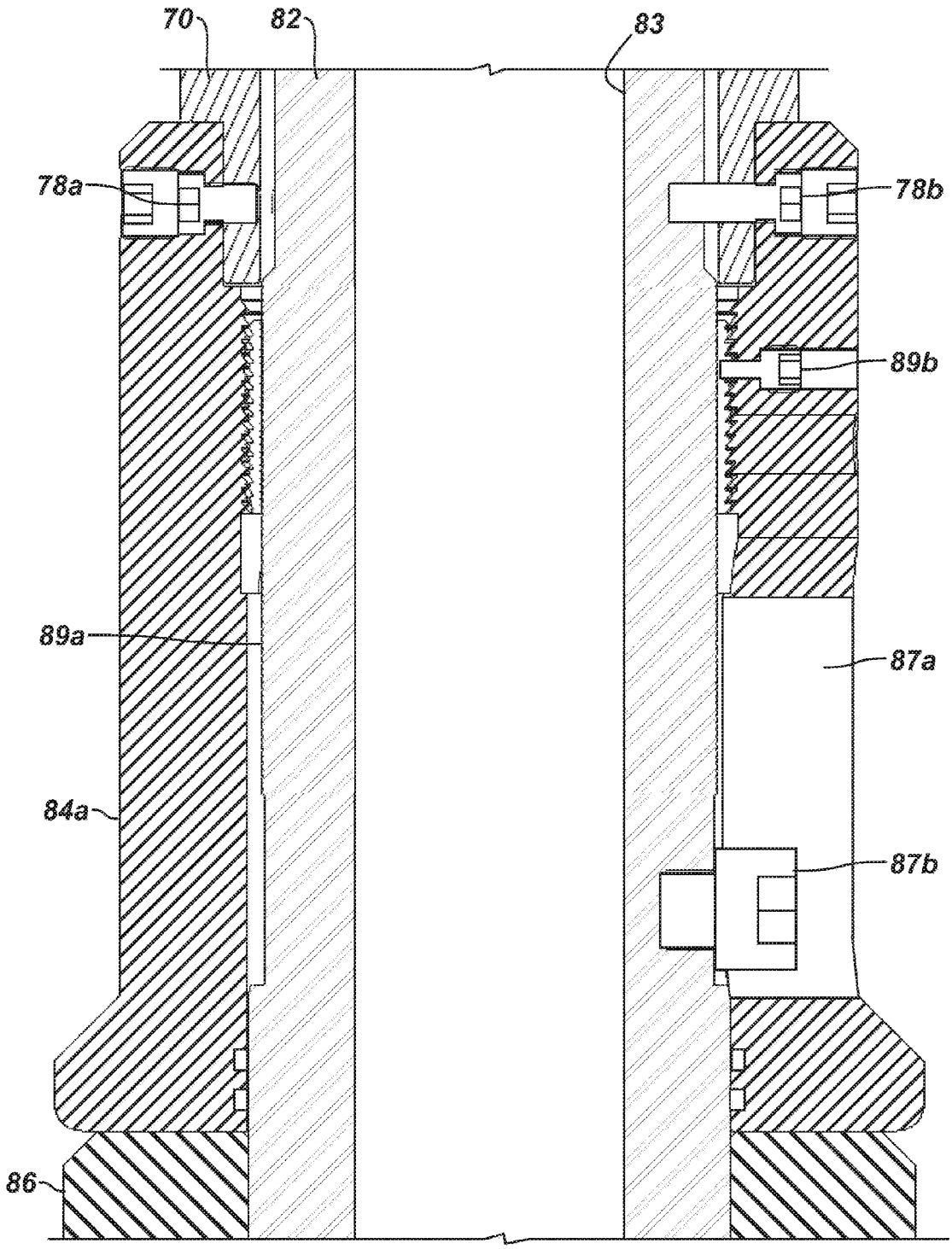
Figure 5A:
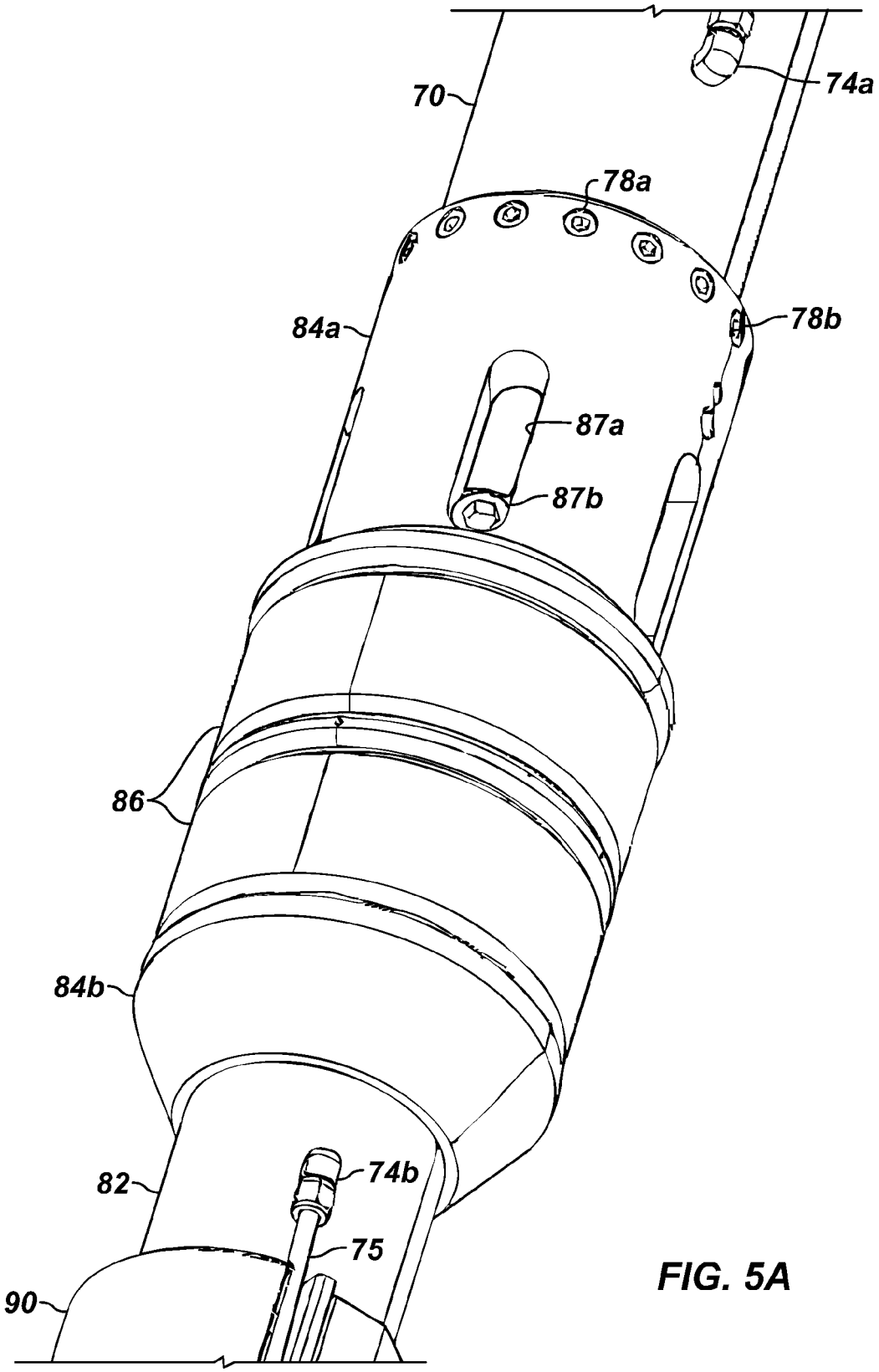
FIG. 5A-5B illustrate details of the upper end ring of the packer and surrounding components on the disclosed whipstock assembly.
Figure 5B:
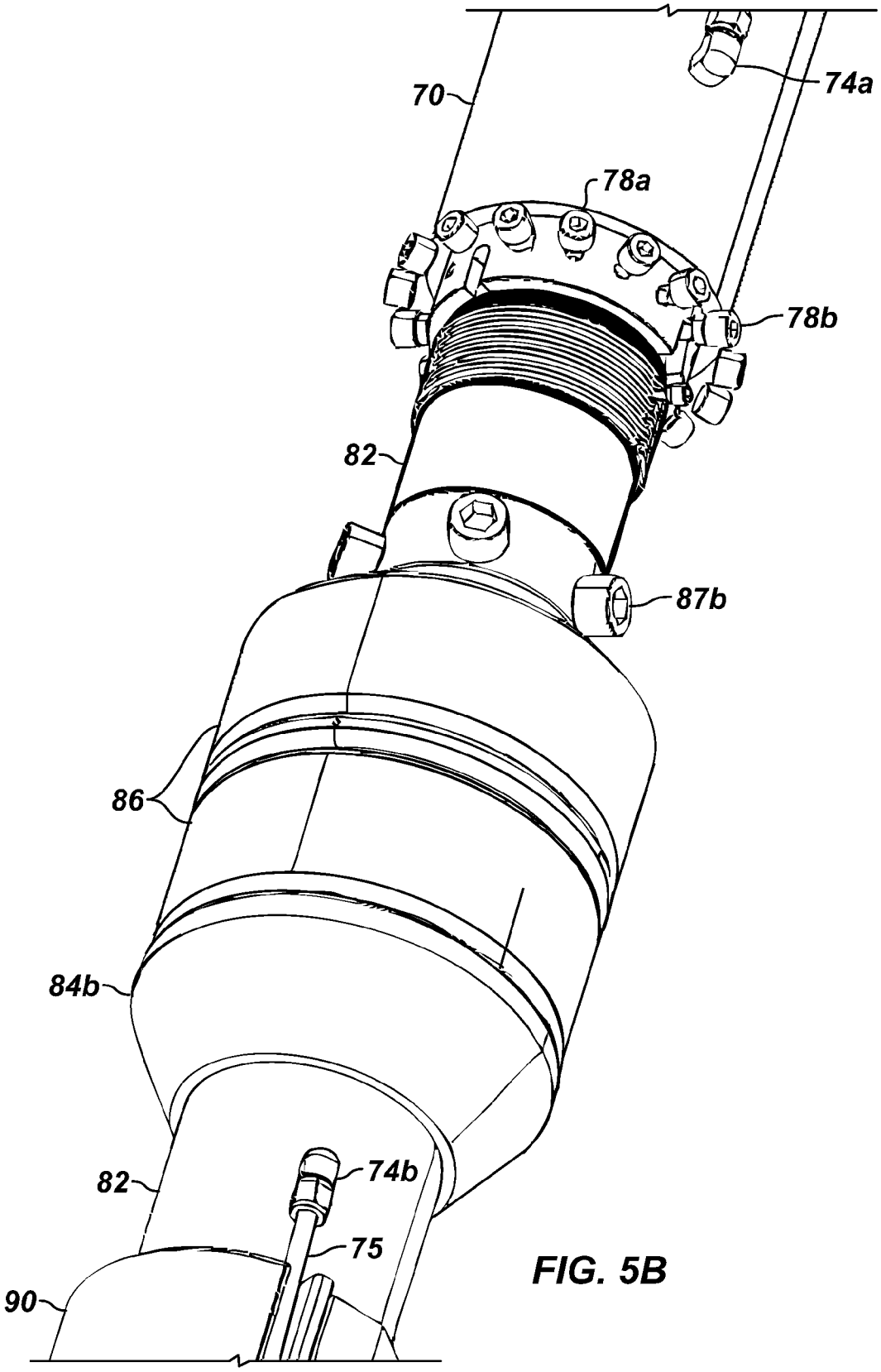

Although the anchor 90 is operated hydraulically, the packer 80 is operated mechanically by the interaction of the whip 60, intermediate member 70, and upper end ring 84*a*. Turning to the operation of the packer 80, discussion turns to FIGS. 4A-4B and 5A-5B, which show various views of the packer 80. In particular, FIGS. 4A-4B illustrate perspective and elevational views of the packer 80 in cross-section. FIG. 5A-5B illustrate the outside of the packer 80 in a perspective view and a partially exposed view with components missing.

The upper (movable) end ring 84*a* is disposed on the packer mandrel 82 and is affixed with shear screws 78*a-b*, pins, elements, or other temporary fixture. A first set of shear screws 78*a* affixes the end ring 84*a* to the intermediate member 70. A second set of the shear screws 78*b* affixes the end ring 84*a* to the mandrel 82.

To set the packer 80 by moving the upper end ring 84*a* against the packing elements 86 and against the lower (fixed) end ring 84*b*, the intermediate member 70 as discussed below pushes the upper end ring 84*a*. The first shear screws 78*a* do not shear free when the intermediate member 70 is forced downward along the mandrel 82 during setting procedures discussed below. The second shear screws 78*b*, however, do shear free when the intermediate member 70 is forced downward along the mandrel 82 at a mechanical setting force. The first shear screws 78*a* can be sheared free when the intermediate member 70 is forced upward during release procedures discussed below.

The shear values for set down with the second set of shear screws 78*b* may be lower than the shear valves for release with the first set of shear screws 78*a*. Moreover, if the anchor 90 is mechanically set, then any shear value associated with the anchor's setting would be lower than setting shear values for the packer 80.

Torque screws 87*b* on the mandrel 82 can ride in guide slots 87*a* on the end ring 84*a*. The torque screws 87*b* transmit torque from the whip 60 to the anchor 90, and the torque screws 87*b* can slide in the slots 87*a* during packer setting. To hold the upper end ring 84*a* in a set state compressed against the packing elements 86, a body lock ring 89*b* on the end ring 84*a* can lockably engage teeth 89*a* disposed on the mandrel 82, allowing movement toward the packing elements 86*a-b* and preventing reverse movement.

Overall, the assembly 50 mechanically sets the packer 80 after the anchor 90 has been set either mechanically or hydraulically. Operation of the packer 80 on the assembly 50 is shown in FIGS. 6A-6D.

Figure 6A:
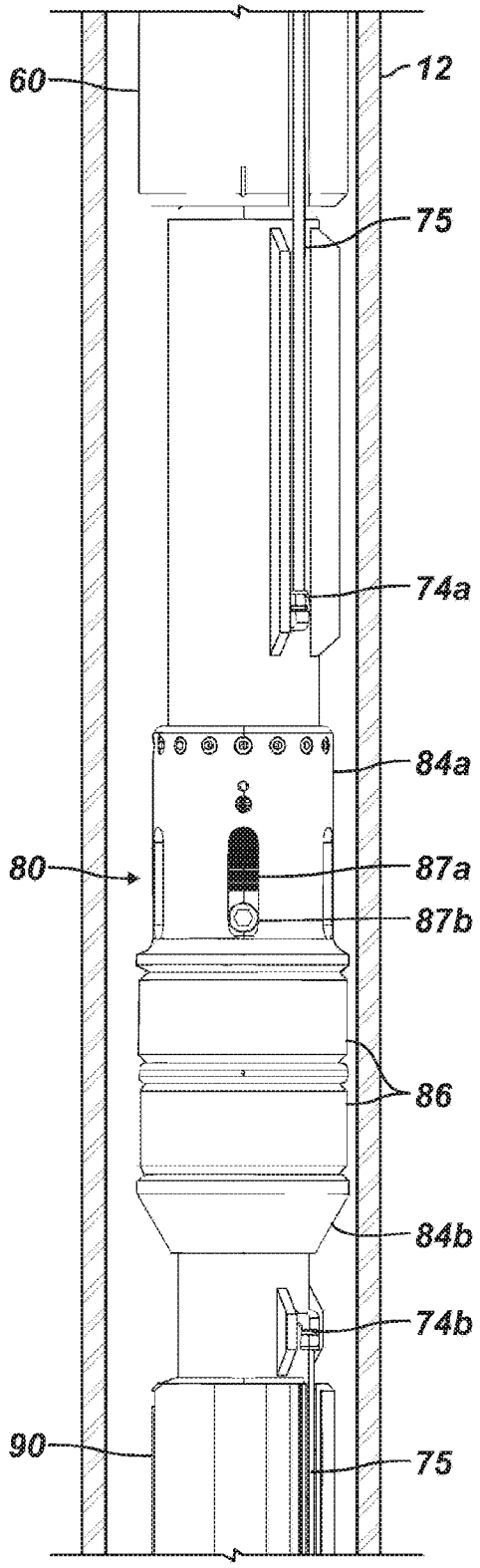
FIGS. 6A-6D illustrate the disclosed whipstock assembly during operation downhole.

As shown more specifically in FIG. 6A, the packer 80 is unset while the assembly 50 is run in the casing 12. Fins or ribs can protect the hydraulic line 75 along the outside of the intermediate member 70 and portion of the anchor 90. Likewise, the whip 60 and the anchor 90 may define channels for the hydraulic line 75.

During run in, the upper end ring 84*a* is held affixed to the intermediate member 70, and the intermediate member 70 is held affixed to the packer mandrel 82 by the shear screws 78*a-b*. In this position, the torque screws 87*b* are disposed in the lower end of the guide slots 87*a* on the end ring 84*a*. Of course, during run in, the anchor 90 is not set, and hydraulic pressure is not yet communicated through the line 75 and mandrel bore 83 to activate the anchor 90.

Figure 6B:
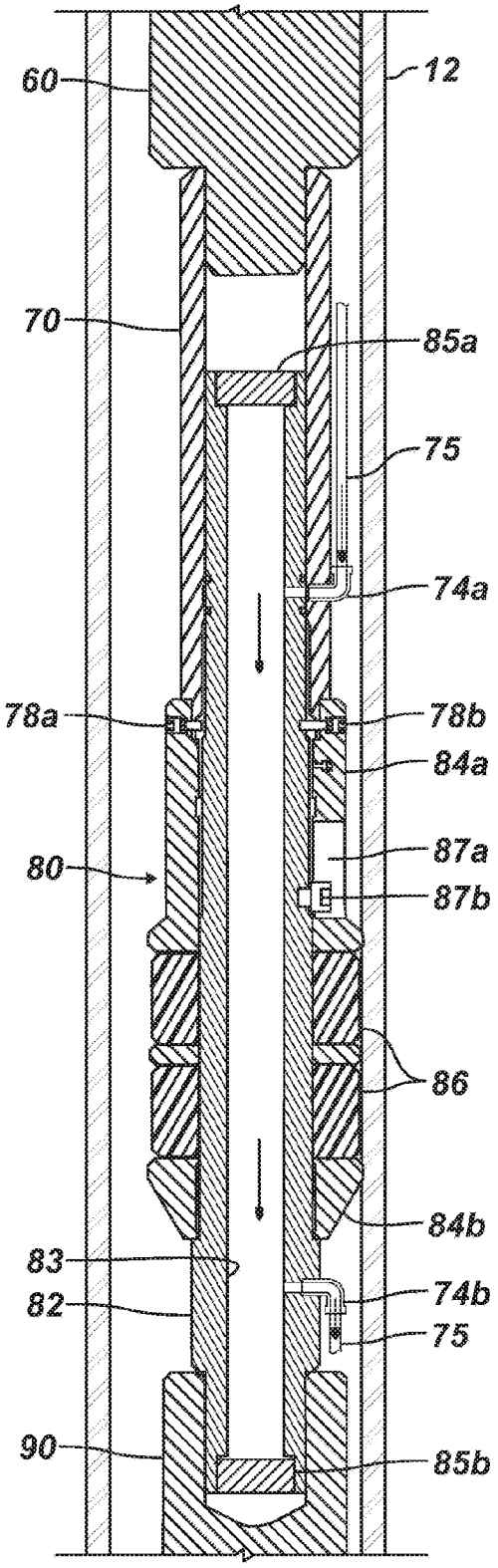

As shown in FIG. 6B, the assembly 50 reaches the desired depth on the casing 12 where the sidetrack wellbore is to be made. Hydraulic pressure is then communicated through the control line 75 and the mandrel bore 83 to activate the anchor 90 and hold the assembly 50 in the casing 12. The hydraulic line fittings 74*a-b* redirect the high pressure setting fluid through the internal bore 83 of the packer 82. The integrity of the hydraulic control line 75 between the packer 80 and the anchor 90 remains intact after the anchor 90 is set, and the piston chamber inside the anchor 90 continues to hold pressure.

Figure 6C:
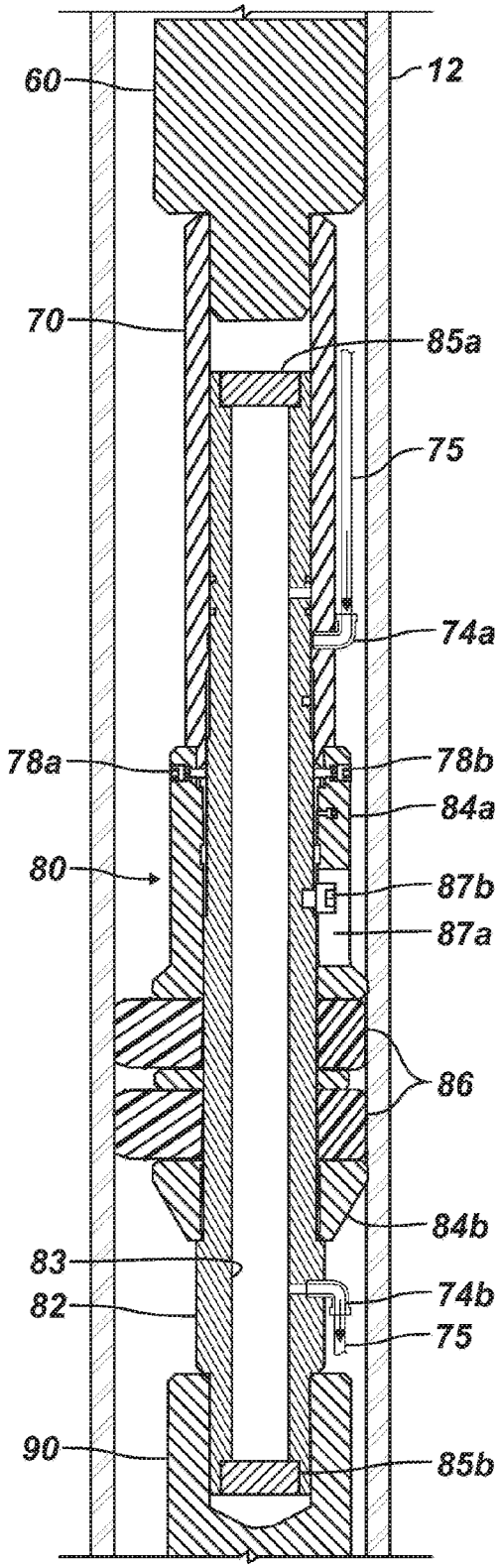

Once the anchor 90 is set as shown in FIG. 6C, the packer 80 sets against the casing 12 on one side and has a large extrusion gap on the opposite side into which the packing element 86 seals when compressed. In this position, the assembly 50 uses a portion of the packer 80 (e.g., the lower gage ring 84*b*) as a fulcrum point to force the tip (not shown) of the whip 60 against the casing 12. Then, the packer 80 once set is arranged not to move the tip of the whip 60 away from the casing 12.

To actually set the packer 80 after the anchor 90 is set, operators put weight on the assembly 50 using the running tool (not shown), which is affixed to the whip 60. Weight is applied by the whip 60 and the intermediate member 70 to shear the screws 78*b*. Freed from the mandrel 82, the end ring 84*a* moves along the mandrel 82 and compresses against the packing elements 86. For example, the weight required to initiate setting may be about 20-25K lb. Then, the minimum weight required to set the packer 80 in the casing 12 can be about 40K lb, and the maximum weight to sustain without losing seal can be about 65K lb. These values are merely exemplary.

As shown in FIG. 6C, the weight from the whip 60 moves the intermediate member 70 against the shear screws 78*b* connecting the end ring 84*a* to the mandrel 82, and the setting shear screws 78*b* shear while stroking down and holding torque. Shearing free, the end ring 84*a* is pressed against the packer elements 86, which in turn are compressed by the lower end ring 84*b*.

When shifted to set the packer 80, the intermediate member 70 eventually seals off the hydraulics. In particular, O-ring seals are disposed on the packer mandrel 82 adjacent the port 83*a* for the hydraulic fitting 74*a*. As the intermediate member 70 slides along the mandrel 82 during setting of the packer 80, the fitting 74*a* slides past the hydraulic port 83*a*. This seals off the fluid path and can be useful if the hydraulic line 75 below the packer 80 leaks.

Under the compression, the packer element 86 extends outward to engage inside the casing 12 to create a fluid seal. As noted above, the set anchor 90 causes the packer 80 to be forced against one side of the casing 12 as a portion of the packer 80 is used as a fulcrum point for pushing the tip of the whip 60 against the casing 12. Because the packer 80 is forced against the casing 12, a very large extrusion gap is formed on one side. The other side of the packer 80 has a very small or no extrusion gap. Therefore, the packing elements' material is preferably capable of moving both circumferentially and radially to pack off in the casing 12. The packing element 86 may also be preconfigured with more material on one side to accommodate the expected extrusion gap relative to the casing 12 when the anchor 90 is set.

With the anchor 90 and packer set 80, operations can continue. For instance, the setting tool (not shown) is disengaged from the whip 60, and milling of a sidetrack wellbore is performed according to standard procedures. The packer 80 transmits torque generated by the milling operation through it to the anchor 90 below.

Figure 6D:
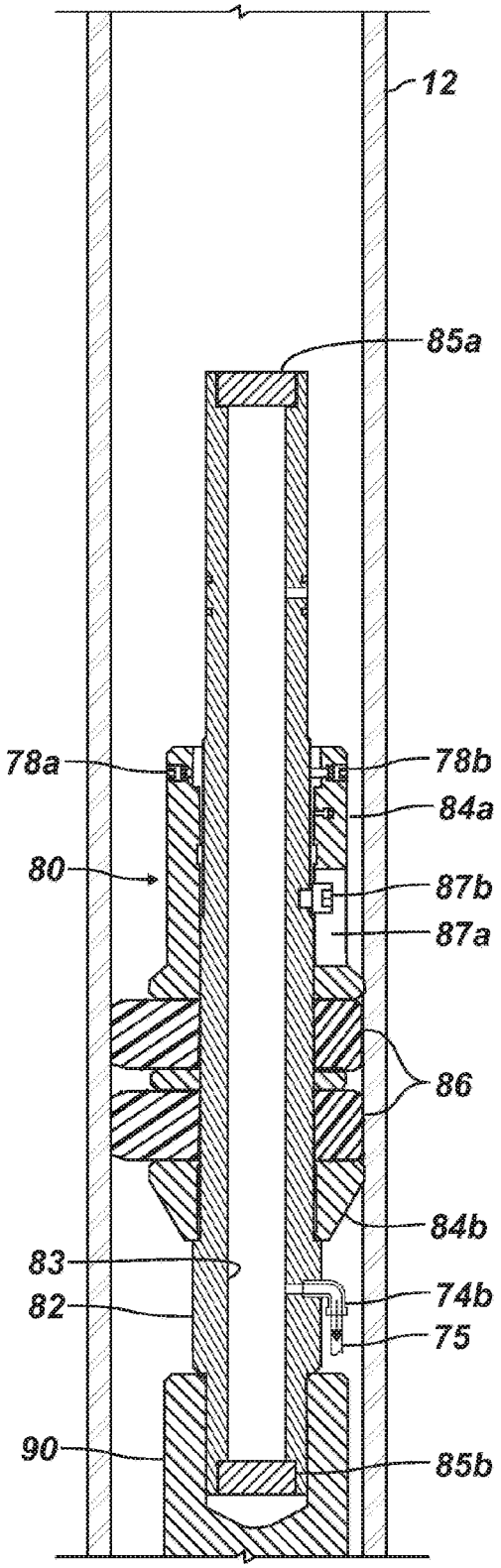

Once the sidetrack wellbore is completed (i.e., drilled, lined with pipe, perforated, etc.), the whip 60 can be removed from the assembly 50, leaving the packer 80 and the anchor 90 in place. To do this, operators engage the whip 60 with a pulling tool (not shown) at a profile (e.g., 64) and pull up on the whip 60 against the packer 80 and anchor 90 set in the casing 12. As shown in FIG. 6D, the intermediate member 70 eventually shears free of the packer mandrel 82 by shearing the first set of shear screws 78*a* used to connect the intermediate member 70 to the upper end ring 84*a*.

The packer 80 and anchor 90 can then be removed according to conventional practices. For example, a milling operation can free the packer 80 from engagement with the surrounding casing 12 so the packer 80 can be washed out. Also, the exposed end of the packer mandrel 82 acts a fishing neck for retrieval.

In addition to shearing of the whip 60 followed by the milling/washover of the packer 80, there are other contingency retrieval operations that can be implemented. For example, retrieval may need to be performed while the assembly 50 is being run in the well to depth and being oriented. If the assembly 50 sets prematurely, the operators will want to remove the entire assembly 50 and bring it to surface. Should the assembly 50 pre-set, the operators can shear the whip 60 from the assembly 50 and can also retrieve the packer 80 and anchor 90 as a unit. This presupposes that the friction of the anchor 90 in the casing is less than the shear value. This retrieval operation can also be used if the operators want to retrieve the assembly 50 even if set properly to depth and after the desired window has been milled.

In the previous version of the packer 80, the inner bore 83 of the packer 80 is used for communicating high-pressure hydraulic fluid to the anchor 90. The bore 83 is filled with fluid and has a mechanism that seals off the inside of the packer 80 as the packer 80 is set. In another version, the hydraulic line 75 can be run through a bulkhead type connector inside the packer 80 to communicate fluid to the anchor 90.

Figure 7A:
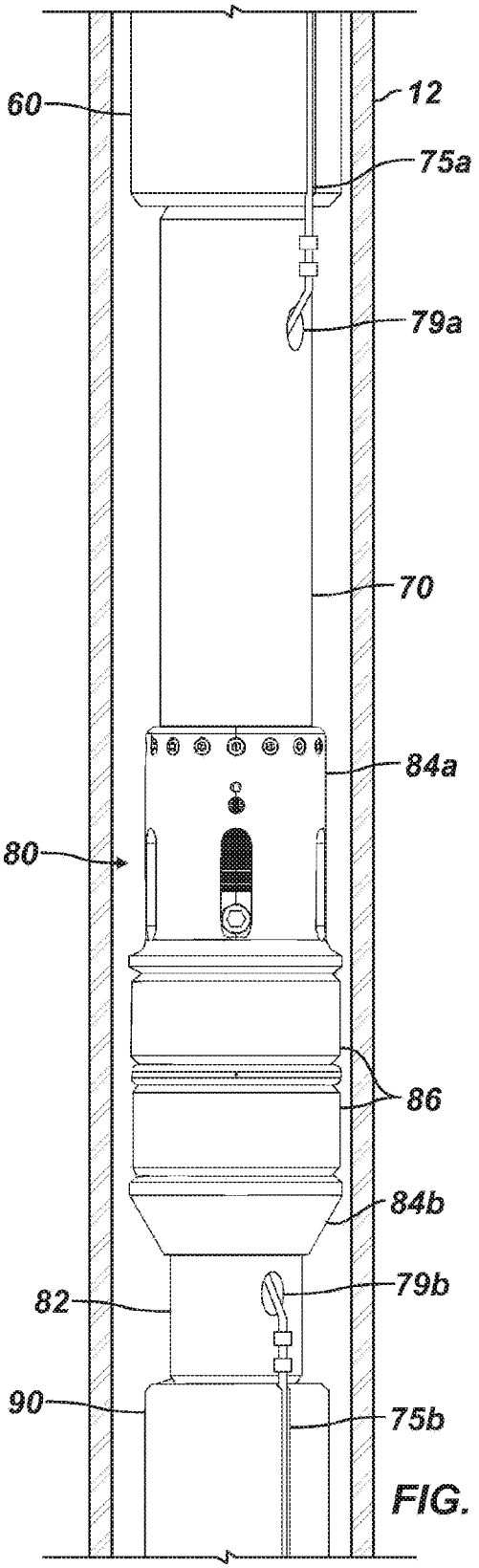
FIGS. 7A-7B illustrate another whipstock assembly according to the present disclosure in elevational and cross-sectional views.
Figure 7B:
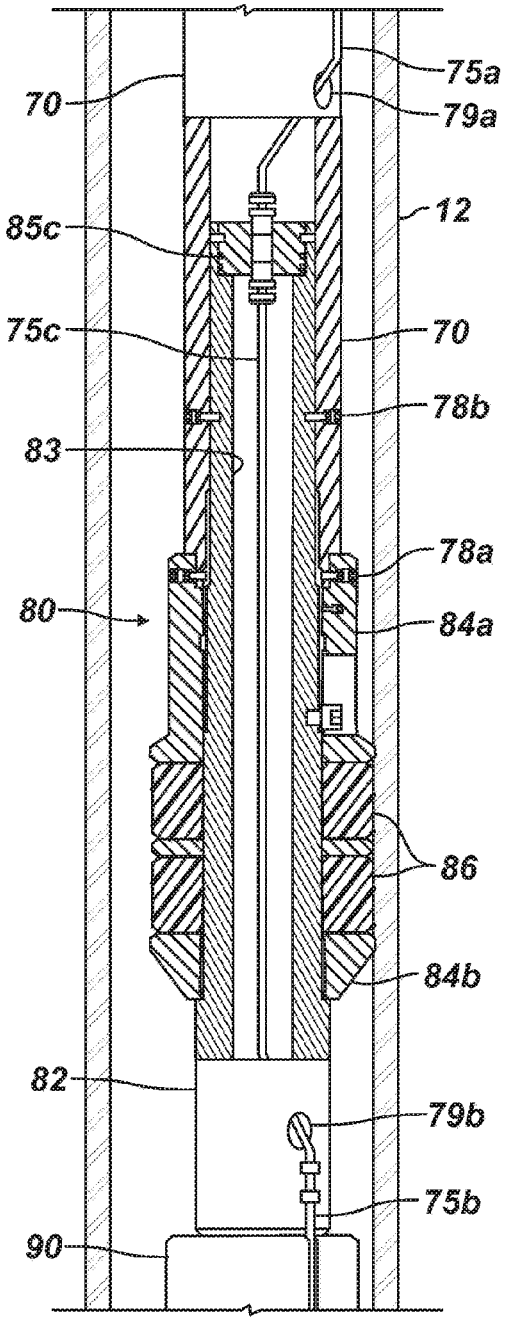

In particular, FIGS. 7A-7B illustrate an elevational view and a partial cross-sectional view of another whipstock assembly 50 according to the present disclosure. This assembly 50 is similar to that discussed previously so that like reference numerals are used for similar components. Rather than communicating the hydraulic pressure for the anchor 90 through the bore 83 of the packer mandrel 82, the current arrangement uses one or more intermediate control lines 75*c* and an end cap 85*c* to communicate the hydraulics from the whip 60, through the packer 80, and to the anchor 90.

As shown, the line 75*a* from the whip 60 terminates and connects to an intermediate line 75*c* with tubing union fittings. The intermediate line 75*c* then passes through an opening 79*a* and into the intermediate member 70. The intermediate line 75*c* affixes with fittings (e.g., two Swagelok straight connectors) to the end cap 85*c* in the mandrel 82, and the intermediate line 75*c* continues and passes through the mandrel's bore 83 to an opening 79*b* downhole on the packer 80. Here, the intermediate line 75*c* connects with tubing union fittings to the lower line 75*b*, which extends to the anchor 90.

The end cap 85*c* is a bulkhead connector sealed and affixed in the mandrel's bore 83. The hydraulic line 75*c* is sealed with fittings to the bulkhead connector 85*c* so the line 75*c* can pass through the connector 85*c*. In this way, the bulkhead connector 85*c* prevents fluid from bypassing the packer 80 through the mandrel's bore 83.

Setting of the anchor 90 and packer 80 can be performed as before. The setting shear screws 78*b* affixing the intermediate member 70 to the mandrel 82 can be disposed as before or can be positioned as shown in FIG. 7B. The release shear screws 78*a* can be disposed as before. When the whip 60 is removed along with the intermediate member 70, the various fittings of the hydraulic line 75*a* may be severed so that the exposed end of the packer mandrel 82 can form a fishing neck as before.

Figure 8A:
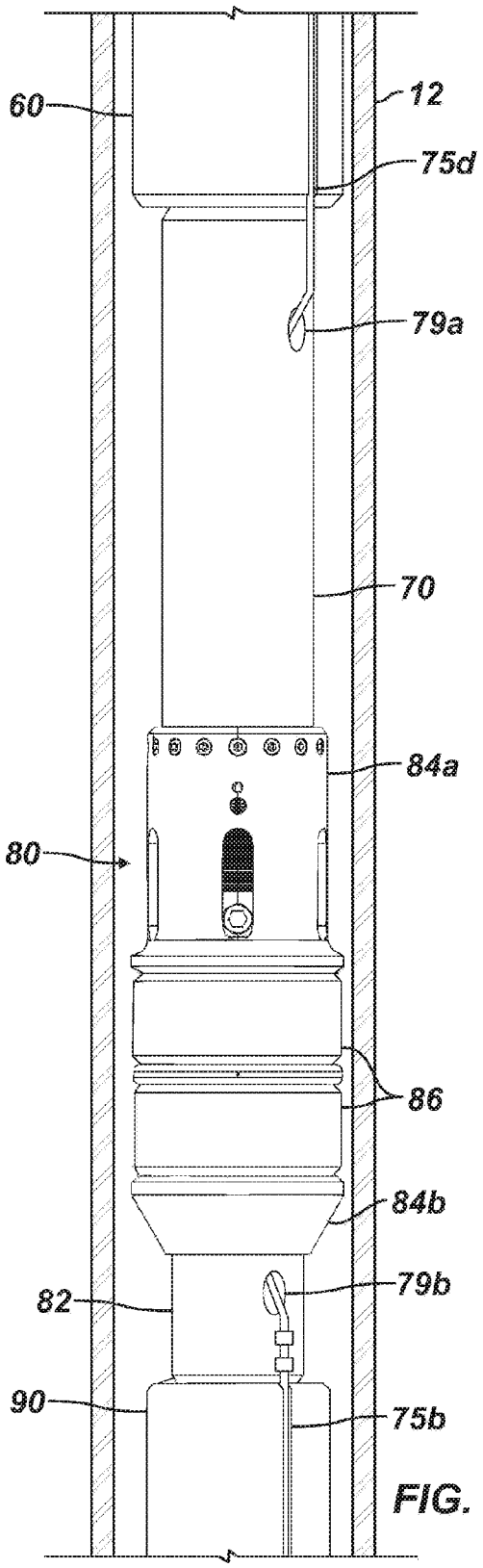
FIGS. 8A-8B illustrate the whipstock assembly in elevational and cross-sectional views with another hydraulic line arrangement.
Figure 8B:
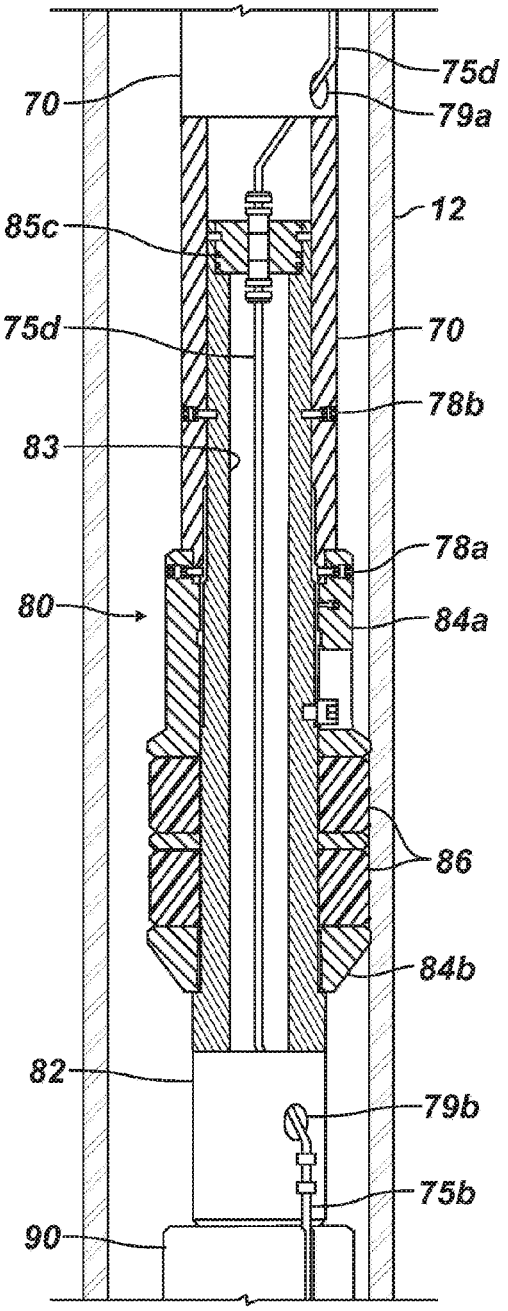

In FIGS. 7A-7B, the assembly 50 uses three hydraulic lines 75*a*, 75*b*, and 75*c*. As an alternative shown in FIGS. 8A-8B, one hydraulic line 75*d* can be used that runs from the intermediate member 70, through the opening 79*a*, through the bulkhead connector 85*c*, along the inner bore 83 of the packer mandrel 82, and out the lower opening 79*b*. A bore-through fitting can be used at the bulkhead connector 85*c*. At this point, the line 75*d* can attach to the anchor's line 75*b* with tubing union fittings. This arrangement eliminates a leakage path between the lines 75*a* and 75*c* of FIG. 7B.

Figure 9A:
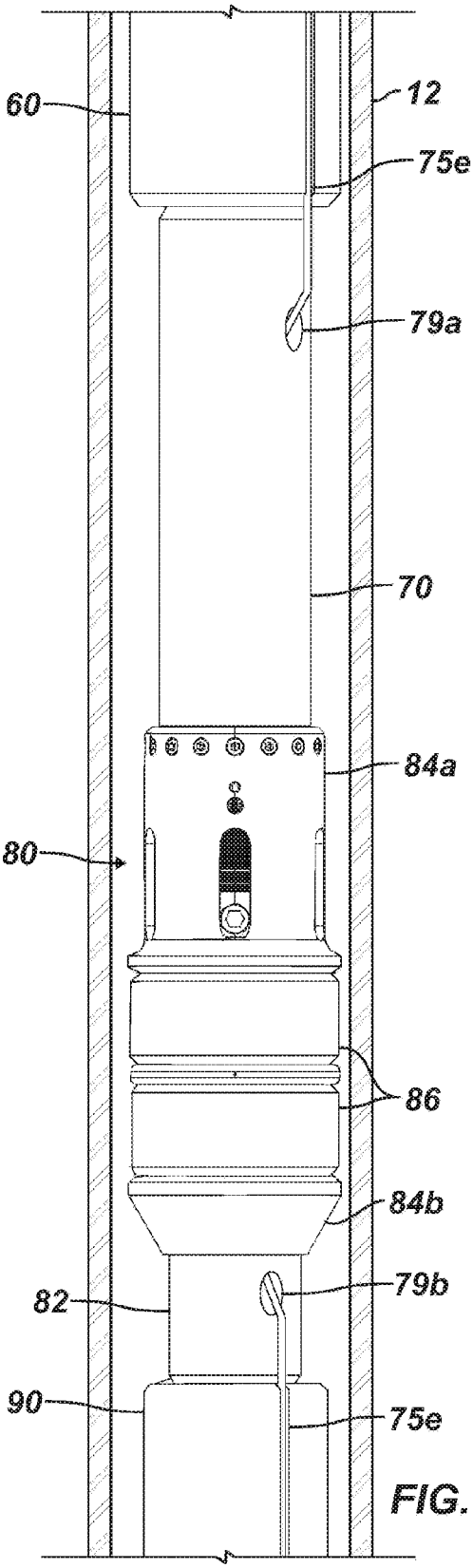
FIGS. 9A-9B illustrate the whipstock assembly in elevational and cross-sectional views with yet another hydraulic line arrangement.
Figure 9B:
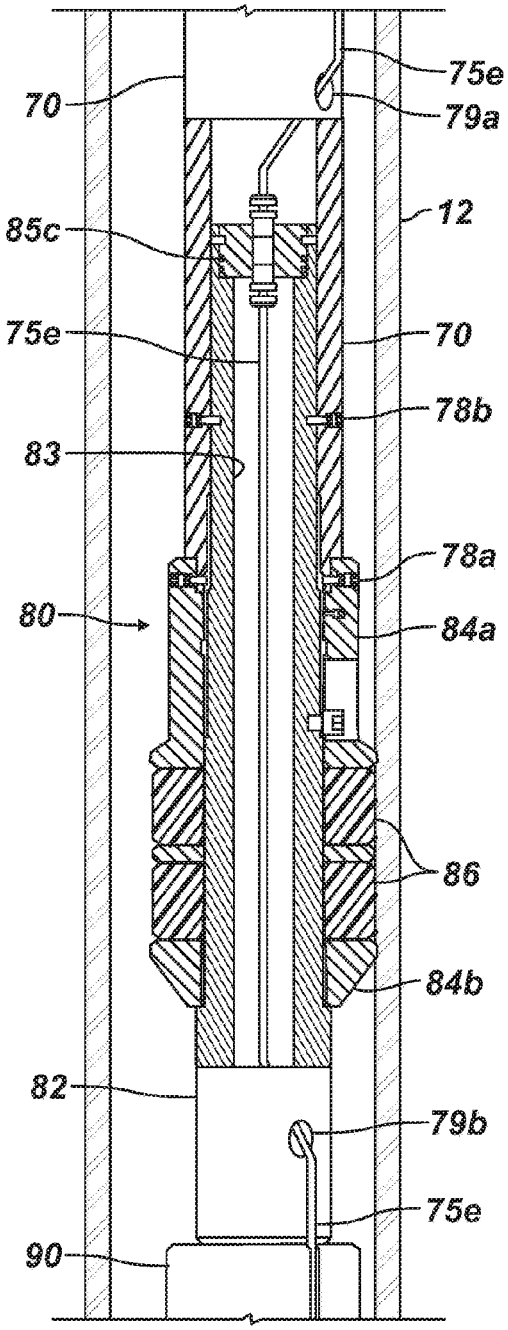

In another alternative shown in FIGS. 9A-9B, another leakage path can be eliminated by using a single hydraulic line 75*e*. The assembly 50 is the same as in FIGS. 8A-8B except that the one hydraulic line 75*e* runs from the intermediate member 70, through the packer 80, and to the mandrel 90. Use of hydraulic fittings at the lower end towards the anchor 90 is eliminated. As expected, the hydraulic line 75*e* is longer to cover the entire length of the anchor 90 where it is to be connected.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A whipstock assembly positioning with a setting tool in a wellbore having casing for forming a sidetrack, the assembly comprising:

a whip removably coupled to the setting tool;

a packer extending from the whip and being settable to seal in the casing; and an anchor extending from the packer and being settable separate from the packer to anchor in the casing, the anchor setting first in the casing in a first setting stage with the packer unset, the packer setting in the casing with a mechanical setting force initiated by a downhole motion of the setting tool against the set anchor in a second setting stage once the anchor has set in the first setting stage.

2. The assembly of claim 1, wherein the anchor comprises a hydraulically-set anchor being hydraulically activatable to anchor in the casing, the assembly further comprising a hydraulic line communicating from the whip to the anchor via the packer.

3. The assembly of claim 1, wherein the anchor comprises a mechanically-set anchor being mechanically activatable to anchor in the casing with a mechanical activation force at least less than the mechanical setting force of the packer.

4. The assembly of claim 1, wherein the packer comprises an end ring and a compressible packing element disposed thereon, the end ring being movable on the packer with the mechanical setting force and compressing the compressible packing element outward toward the casing.

5. The assembly of claim 4, wherein the packer comprises at least one torque screw disposed thereon and engaged in at least one slot in the end ring.

6. The assembly of claim 4, wherein the end ring comprises a body lock connection with the packer allowing movement with the mechanical setting force against the compressible packing element and preventing reverse movement.

7. The assembly of claim 1, wherein the set anchor positions the unset packer eccentrically in the casing, at least a portion of the eccentrically-positioned packer acting as a fulcrum point tending to position a tip of the whip against the casing.

8. The assembly of claim 1, wherein the packer defines an internal passage, a hydraulic line for setting the anchor passing through the internal passage from the whip to the anchor.

9. The assembly of claim 8, wherein the internal passage comprises a bulkhead connector disposed therein and through which a portion of the hydraulic line passes from the whip to the anchor.

10. The assembly of claim 1, wherein the packer defines an internal passage, a first portion of a hydraulic line for setting the anchor communicating from the whip with the internal passage on one side of a compressible packing element on the packer, a second portion of the hydraulic line communicating with the internal passage on an opposite side of the packing element to the anchor, the internal passage communicating the first and second portions of the hydraulic lines with one another.

11. The assembly of claim 10, wherein the packer seals at least the first portion of the hydraulic line from the internal passage when set with the mechanical setting force.

12. The assembly of claim 1, comprising a first temporary connection between the packer and the whip releasing in response to the mechanical setting force applied to the assembly.

13. The assembly of claim 12, wherein the first temporary connection comprises:

an intermediate member connected to the whip and movably disposed adjacent a compressible packing element of the packer; and one or more first shear elements temporarily affixing the intermediate member to the packer.

14. The assembly of claim 13, further comprising a second temporary connection between the packer and the whip releasing in response to a mechanical releasing force applied to the assembly, the whip disconnecting from the packer with the mechanical releasing force.

15. The assembly of claim 14, wherein the second temporary connection comprises one or more second shear elements temporarily affixing the intermediate member to an end ring of the packer adjacent the compressible packing element.

16. A whipstock assembly positioning with a setting tool in a wellbore having casing for forming a sidetrack, the assembly comprising:

a whip removably coupled to the setting tool;

a packer extending from the whip and being mechanically activatable in a second setting stage to seal in the casing with a mechanical setting force;

an anchor extending from the packer and being activatable in a first setting stage separate from the packer with a downhole motion of the setting tool to anchor in the casing with the packer unactivated; and a first temporary connection between the packer and the whip releasing in response to the mechanical setting force applied to the assembly and initiating the setting of the packer with the downhole motion of the setting tool against the activated anchor in the second setting stage once the anchor has set in the first setting stage in the casing.

17. The assembly of claim 16, further comprising a second temporary connection between the packer and the whip releasing in response to a mechanical releasing force applied to the assembly, the whip disconnecting from the packer with the mechanical releasing force.

18. A method of forming a sidetrack in a wellbore having casing, the method comprising:

deploying, in the casing with a setting tool, a whipstock assembly having a whip, a packer extending from the whip, and an anchor extending from the packer;

anchoring the whipstock assembly in the casing by setting the anchor separate from the packer in a first setting stage in the casing with the packer unset;

mechanically setting the packer in the casing with a mechanical setting force initiated by a downhole motion of the setting tool against the set anchor in a second setting stage once the anchor has set in the first setting stage; and forming the sidetrack in the wellbore using the whip of the whipstock assembly.

19. The method of claim 18, wherein setting the anchor in the casing comprises mechanically setting the anchor with a mechanical activation force at least less than the mechanical setting force of the packer.

20. The method of claim 18, wherein setting the anchor in the casing comprises setting the anchor with hydraulics communicated from the whip to the anchor through the packer.

21. The method of claim 20, wherein setting the anchor with the hydraulics communicated from the whip to the anchor through the packer comprises communicating a hydraulic line from the whip to the anchor through an internal passage of the packer.

22. The method of claim 20, wherein setting the anchor with the hydraulics communicated from the whip to the anchor through the packer comprises communicating a first portion of a hydraulic line from the whip to an internal passage of the packer on one side of a compressible packing element, and communicating a second portion of the hydraulic line from internal passage of the packer on an opposite side of the compressible packing element to the anchor.

23. The method of claim 22, further comprising sealing, with the packer, at least the first portion of the hydraulic line from the internal passage when setting the packer with the mechanical setting force.

24. The method of claim 18, wherein mechanically setting the packer in the casing with the mechanical setting force after setting the anchor comprises moving an end ring on the packer with the mechanical setting force against a compressible packing element on the packer and compressing the compressible packing element outward toward the casing.

25. The method of claim 18, wherein mechanically setting the packer in the casing with the mechanical setting force after setting the anchor comprises freeing a first temporary connection of the assembly with the mechanical setting force applied to the assembly.

26. The method of claim 25, wherein freeing the first temporary connection of the assembly with the mechanical setting force applied to the assembly comprises:

providing an intermediate member connected to the whip and movably disposed adjacent a compressible packing element of the packer; and shearing a temporarily affixing of the intermediate member to the packer.

27. The method of claim 26, further comprising mechanically disconnecting the whip of the assembly from the packer by freeing a second temporary connection between the packer and the whip with a mechanical releasing force applied to the assembly.

28. The method of claim 27, wherein freeing the second temporary connection between the packer and the whip with the mechanical releasing force applied to the assembly comprises shearing another temporarily affixing of the intermediate member to an end ring of the packer adjacent the compressible packing element.

29. The method of claim 18, wherein setting the anchor in the casing before setting the packer comprises positioning the unset packer eccentrically in the casing, and using at least a portion of the eccentrically-positioned packer as a fulcrum point to urge a tip of the whip against the casing.

* * * * *